US006681821B1

(12) United States Patent
Cirone

(10) Patent No.: US 6,681,821 B1
(45) Date of Patent: Jan. 27, 2004

(54) PROTECTIVE BAT COVER

(76) Inventor: Dominick Cirone, 5441 E. Angela Dr., Scottsdale, AZ (US) 85254

( * ) Notice: Subject to any disclaimer, the term of this patent is extended or adjusted under 35 U.S.C. 154(b) by 0 days.

(21) Appl. No.: 09/664,537

(22) Filed: Sep. 18, 2000

(51) Int. Cl.[7] ..... B65D 65/02
(52) U.S. Cl. ..... 150/154; 206/315.1; 150/160; 473/457
(58) Field of Search ..... 150/154, 160; 206/315.1; 473/457

(56) References Cited

U.S. PATENT DOCUMENTS

| | | | | |
|---|---|---|---|---|
| 2,115,307 | A | | 4/1938 | Kneeter |
| 2,389,390 | A | * | 11/1945 | Silverman et al. ..... 215/11.6 |
| 2,417,336 | A | | 3/1947 | Whitehead |
| D191,315 | S | | 9/1961 | Damiani et al. |
| 3,072,167 | A | | 1/1963 | Banas |
| 3,255,794 | A | | 6/1966 | Morse |
| 3,426,815 | A | | 2/1969 | Ashlin et al. |
| 3,478,799 | A | | 11/1969 | Hoyt, Jr. |
| 3,593,769 | A | | 7/1971 | Spears |
| 3,623,724 | A | * | 11/1971 | Lande ..... 473/457 |
| 3,726,659 | A | | 4/1973 | Shuford |
| 3,754,587 | A | | 8/1973 | Rainieri |
| 3,821,976 | A | | 7/1974 | Smith et al. |
| 3,977,451 | A | | 8/1976 | Duba |
| 4,119,129 | A | | 10/1978 | Freiberg |
| 4,176,770 | A | | 12/1979 | Griggs et al. |
| 4,220,302 | A | | 9/1980 | Hampton et al. |
| 4,282,279 | A | | 8/1981 | Strickland |
| 4,345,704 | A | | 8/1982 | Boughton |
| 4,368,768 | A | | 1/1983 | Cunko, Jr. |
| 4,378,832 | A | | 4/1983 | Thompson |
| D268,943 | S | | 5/1983 | Miller |
| 4,401,245 | A | * | 8/1983 | Zills ..... 224/148 |
| 4,418,733 | A | | 12/1983 | Kallman |
| 4,420,104 | A | | 12/1983 | DiIenno |
| D273,968 | S | | 5/1984 | Masai et al. |
| 4,453,632 | A | | 6/1984 | Clower |
| 4,548,375 | A | | 10/1985 | Moss |
| 4,596,370 | A | | 6/1986 | Adkins |
| 4,634,089 | A | | 1/1987 | Wright et al. |
| 4,690,300 | A | | 9/1987 | Woods |
| 4,708,254 | A | | 11/1987 | Byrns |
| 4,718,263 | A | | 1/1988 | Crout et al. |
| 4,721,276 | A | | 1/1988 | Moss |
| D295,544 | S | | 5/1988 | Rice |
| 4,779,831 | A | | 10/1988 | Anderson |
| 4,785,934 | A | * | 11/1988 | Hoggle ..... 150/154 X |
| 4,796,937 | A | | 1/1989 | Andrea |
| 4,800,119 | A | | 1/1989 | Kolar |
| D301,047 | S | | 5/1989 | Pace |
| 4,848,625 | A | | 7/1989 | Lucia |
| 4,898,222 | A | | 2/1990 | Gaffney |
| 4,951,910 | A | | 8/1990 | March |
| 4,955,516 | A | | 9/1990 | Satterfield |
| D312,289 | S | | 11/1990 | Pace |
| 4,971,126 | A | | 11/1990 | Borenstein |
| 4,989,811 | A | * | 2/1991 | Millis et al. ..... 248/104 |

(List continued on next page.)

FOREIGN PATENT DOCUMENTS

| | | |
|---|---|---|
| AU | 261329 | 5/1965 |
| GB | 1 397 252 | 6/1975 |
| GB | 2 133 700 A | 8/1984 |
| GB | 2 233 239 A | 1/1991 |
| GB | 1 360 058 | 7/1994 |
| JP | 3-165785 | 7/1991 |

*Primary Examiner*—Tri M. Mai
(74) *Attorney, Agent, or Firm*—Mintz Levin Cohn Ferris Glovsky and Popeo PC

(57) ABSTRACT

A cover for protecting the barrel portion of a baseball bat, or other structure is disclosed. The cover is preferably formed from an elastic rubber material such as neoprene. The flexible cover has the ability to adapt its shape upon insertion of a bat, enabling use with bats of various sizes. The cover is water resistant and is adapted for maximizing the visibility of printed matter thereon.

2 Claims, 3 Drawing Sheets

U.S. PATENT DOCUMENTS 5,005,624 A 4/1991 Sung
5,007,566 A * 4/1991 Fick ..... 224/414
5,042,770 A 8/1991 Louthan
5,105,863 A 4/1992 Cirone
5,109,578 A 5/1992 Cox
5,110,020 A 5/1992 Uhl
5,117,884 A 6/1992 Diener et al.
5,133,395 A 7/1992 Moore
D330,401 S 10/1992 Harris, Jr.
5,163,608 A * 11/1992 Block ..... 220/903 X
5,174,481 A * 12/1992 LeDune ..... 206/315.1
5,195,568 A * 3/1993 Cirone ..... 206/315.2
5,199,678 A 4/1993 Luebke
5,213,324 A * 5/1993 Bowers ..... 473/457 X
5,249,770 A 10/1993 Louthan
5,299,611 A 4/1994 Cirone
5,299,720 A 4/1994 Koch, III
5,325,991 A 7/1994 Williams
5,344,055 A 9/1994 Edwards
5,348,296 A * 9/1994 Frederiksen ..... 463/47.2
5,381,922 A 1/1995 Gladman et al.
5,390,887 A 2/1995 Campbell
5,403,009 A * 4/1995 Gleason, Jr. ..... 150/160 X
5,425,484 A 6/1995 Kawand et al.
5,427,285 A 6/1995 Kreitzman
5,443,192 A 8/1995 Hodges et al.
5,454,492 A 10/1995 Hunter et al.
5,464,183 A 11/1995 McConnell et al.
5,494,248 A 2/1996 Pratt et al.
5,497,920 A 3/1996 Moeller et al.
5,503,316 A 4/1996 Stewart
5,522,592 A * 6/1996 Evelsizer, Jr. ..... 150/160
5,605,325 A * 2/1997 Haringa ..... 473/457
5,622,346 A 4/1997 Story, Jr.
D383,182 S 9/1997 Estell
5,661,920 A * 9/1997 Evans ..... 150/154 X
5,701,998 A * 12/1997 Perry et al. ..... 206/315.1
5,738,157 A * 4/1998 Gaffney ..... 150/160
5,786,574 A 7/1998 Garnett
RE35,899 E 9/1998 Cirone
5,806,730 A 9/1998 Deno
5,871,092 A 2/1999 Rogers et al.
5,888,154 A * 3/1999 Hartman ..... 473/457
6,004,033 A 12/1999 Cirone
6,065,764 A * 5/2000 Moseley ..... 280/33.992
6,093,114 A 7/2000 Haringa
6,123,597 A 9/2000 Matthews et al.
6,176,403 B1 * 1/2001 Svare et al. ..... 206/315.1

* cited by examiner

PROTECTIVE BAT COVER

BACKGROUND OF THE INVENTION

1. Field of the Invention

The field of this invention relates to a protective cover for a bat, such as a baseball or softball bat.

2. Description of Related Art

Bats used for baseball, softball, and the like are generally constructed from metal or wood. Accordingly, prolonged exposure to sunlight, heat, moisture, and general inclement weather may result in damage to a bat. The life-span of a bat can also be reduced by careless handling on the part of those individuals using the bat. Gouges, knicks, splinters (with wooden bats), and scrapes, for example, may result when bats are improperly stored together, or allowed to bang into various other objects.

Several protective articles for bats are known. These articles, however, typically comprise cumbersome carrying cases and bags, many of which are designed to house several bats at one time. Bat bags in particular may be disadvantageous, as damage may result from multiple stored bats banging into one another. Additionally, such articles may be undesirable for those individuals who seek a protective cover that is lightweight, flexible, and that can be attached to, and removed from a single bat in a quick and convenient manner.

These and other drawbacks exist.

SUMMARY OF THE INVENTION

The invention solving these and other problems in the art relates to a protective cover for a bat, or other structure. The cover is preferably formed from an elastic rubber material such as neoprene.

One advantage provided by the protective bat cover is that it is lightweight, flexible, and easy to use, allowing for attachment to and removal from a bat or similar object in a quick and convenient manner.

Another advantage of the protective bat cover over other known bat covers, is an increased life span due to construction from a material having a greater resistance to harmful environmental elements.

Yet another advantage of the protective bat cover is its ability to protect the barrel of a bat from harmful environmental conditions, as well as damage resulting from inadvertent contact with various other objects.

Yet another advantage of the protective bat cover is its ability to increase the range of temperatures in which the bat may be used without being damaged. Metal baseball bats, in particular, are known to experience a change in properties, often becoming harder in colder temperatures and softer in warmer temperatures. Use of the bat during these periods of hot and cold temperatures may make the bat more susceptible to dings and knocks, among other types of damage. A protective bat cover made of neoprene possesses insulative properties that serve to keep a bat warmer in colder temperatures, and vice versa.

Still yet another advantage of the protective bat cover is its ability to adapt its shape upon insertion of a bat, enabling use with various sized bats. The ability of neoprene to stretch, as well as its "memory-specific" nature, enables the protective bat cover to be easily secured to, and removed from bats with a diameter that is slightly larger than that of the cover.

An additional advantage of the protective bat cover is the provision of a fastening mechanism thereon, which facilitates the placement of the cover on the bat, while enabling a relatively secure attachment to the bat.

Another advantage of the protective cover is its adaptability for maximizing the visibility of various logos or graphics printed thereon. The surface area of the protective cover facilitates the prominent display of a team name, company name, team logo, graphic, or other design, especially in instances when the protective cover is being viewed from a distance.

These and other objects, features and advantages of the invention will be apparent through the detailed description of the preferred embodiments and the drawings attached hereto. It is also to be understood that both the foregoing general description and the following detailed description are exemplary and explanatory and not restrictive of the scope of the invention.

BRIEF DESCRIPTION OF THE DRAWINGS

The invention will be described with respect to the accompanying drawings, in which like elements are referenced with like numbers.

DETAILED DESCRIPTION OF THE PREFERRED EMBODIMENTS

As used herein, the term "bat" includes a baseball bat, softball bat, or any other article having a similar structure, used in either a recreational or non-recreational setting, or otherwise. In general, a bat may be said to include a handle portion and a barrel portion, with embodiments of the invention directed toward protecting either one or both of the handle and barrel portions.

Figure 1:
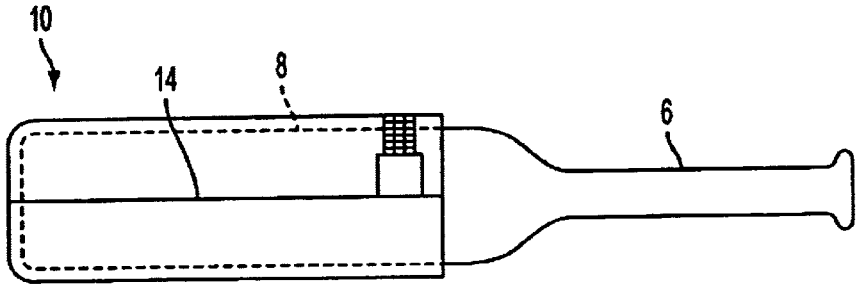
FIG. 1 is a plan view of a protective bat cover encasing the barrel of a bat, according to one embodiment of the invention.

FIG. 1 illustrates a protective bat cover 10 secured to the barrel portion 8 of a bat 6. According to one aspect of the invention, the cover 10 permits the rapid and easy connection and disconnection to and from the barrel portion 8 of the bat 6 (or other structure). Preferably, the cover 10 is made of an elastic rubber material such as neoprene. One advantage of neoprene is its ability to conform to the shape of the barrel, which enables the cover 10 to be used with various sized bats, and which ensures a secure fit when placed over a bat. The ability of neoprene to flex, as well as its ability to retain the "memory" of a barrel shape, allows the protective bat cover to be easily secured to, and removed from bats with a diameter that may even be slightly larger than that of the cover.

Neoprene also exhibits greater weather resistance than less elastic materials such as plastics, leather, nylon, and the like, which tend to be more susceptible to cracking, expansion, and other undesirable effects. This allows the protective bat cover to increase the range of temperatures in which a bat may be used without being damaged. Metal baseball bats, for example, are known to experience a change in properties, often becoming harder in colder temperatures and softer in warmer temperatures. When a bat is used during these periods of hot and cold temperatures, it is likely to be more susceptible to dings and knocks, among other types of damage. A protective bat cover made of neoprene possesses insulative properties that serve to keep a bat warmer in colder temperatures, and vice versa. While neoprene is the preferred material for implementing the present invention, it should be recognized that any similar materials having the desired properties may be used.

Figure 2:
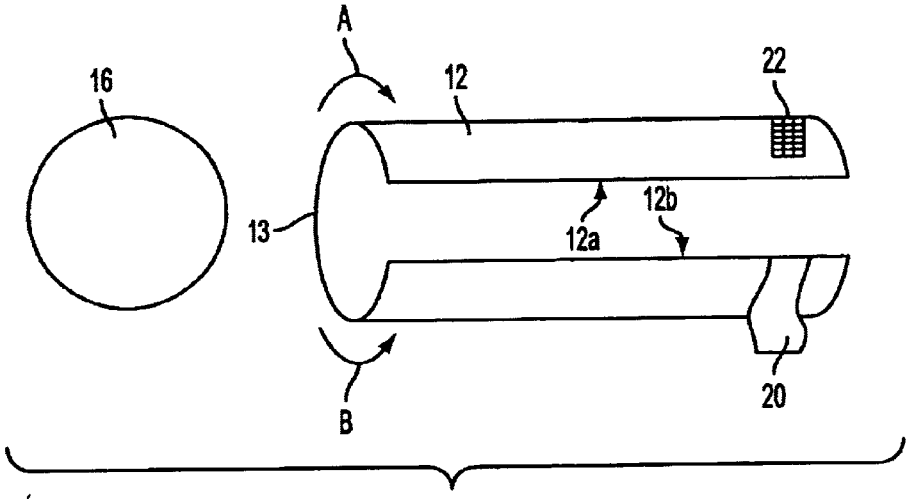
FIG. 2 illustrates the shapes of the pieces comprising a protective bat cover during assembly, according to one embodiment of the invention.
Figure 3:
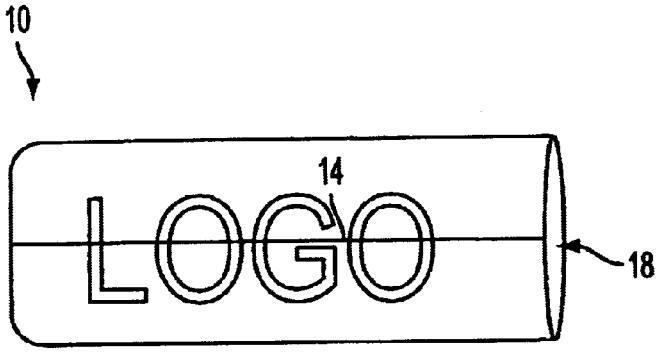
FIG. 3 is a plan view of a protective bat cover, according to one embodiment of the invention.
Figure 4:
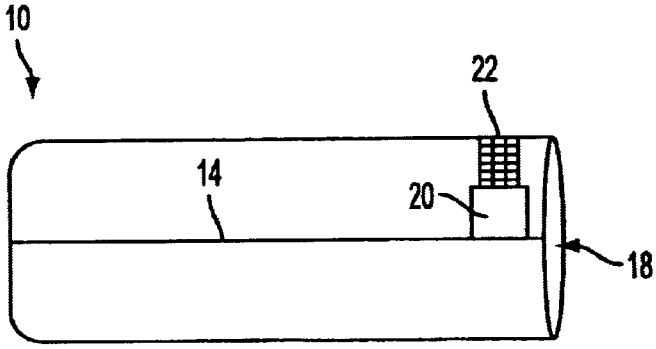
FIG. 4 is a plan view of a protective bat cover, according to another embodiment of the invention.

According to one embodiment of the invention, protective cover 10 may be assembled by cutting a piece of material into the two general shapes illustrated in FIG. 2. A first material piece 12 is preferably cut into a generally rectangular shape, having a substantially first straight edge 12*a* and a substantially second straight edge 12*b*. The first and second edges (12*a*, 12*b*) may be folded toward one another in the general direction illustrated by arrows A and B. First and second edges (12*a*, 12*b*) are stitched or otherwise fastened together to form a seam 14, with first material piece 12 now forming a hollow, tubular casing having two open ends. A second material piece 16, preferably cut into the shape of a circle, may then be stitched or otherwise fastened to an open end 13 of the first material piece 12, forming a protective cover 10 having one closed end and one open end 18. Such a cover is illustrated in FIG. 3. The shapes of first material piece 12 and second material piece 16, as seen in FIG. 2, are representative of a family of shapes that may be joined to form protective cover 10. Any orientation, geometric description or configurations of the material pieces described or shown are illustrative only, and accordingly should not be viewed as limiting. Similarly, protective cover 10 may be manufactured using only one piece of material, or any number of pieces of material using any known manufacturing techniques or methods. Those skilled in the art will understand that one or more material pieces may be stitched, glued, or seamed together in a number of different ways to achieve a protective bat cover as described and illustrated herein.

While a material such as neoprene is ideal because of its ability to conform to the shape of the barrel, it may also be desirable to include a fastening mechanism with the cover 10, such as a hook and loop fastener (more commonly known as VELCRO™). As illustrated in FIG. 2, a strip 22 of either hook or loop material may be stitched or otherwise fastened to first material piece 12. A strap 20 may be fastened to an edge of the first material piece, containing either hook or loop material, depending on the type of material provided on strip 22. If strip 22 contains hook material, for example, the strap 20 preferably comprises loop material, and vice versa. FIGS. 1, and 4–6 illustrate embodiments of the invention in which hook and loop fasteners are utilized. In alternative embodiments (not shown), strips having button-snaps or other fastening mechanisms may also be used.

In order to use the protective cover 10, the user merely slips the barrel portion 8 of the bat 6 into the opening 18 of the cover, and then pulls the cover down over the barrel of the bat, preferably as far as possible. Strap 20 may then be fastened to strip 22 in order to further secure the cover to the bat. As illustrated in FIG. 3, ample area exists on cover 10 for prominently displaying a logo or graphic.

Figure 5:
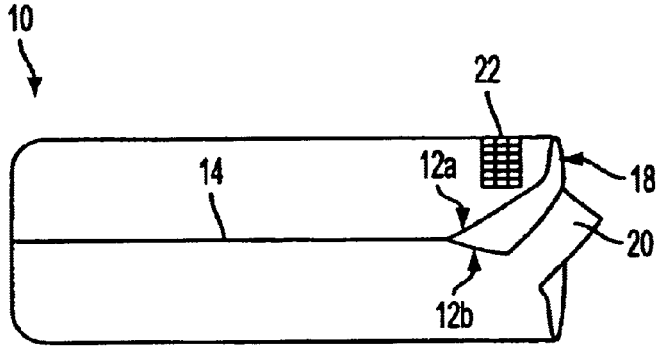
FIG. 5 is a plan view of a protective bat cover, according to yet another embodiment of the invention.

In the foregoing embodiments, the first and second edges (12*a*, 12*b*) of first material piece 12 have been stitched or otherwise fastened together to form a seam 14 that extends the entire length of the cover. In another embodiment of the invention, as illustrated in FIG. 5, the first and second edges (12*a*, 12*b*) may be fastened together to form a seam 14 that extends only partially along the length of the cover 10, leaving a split that extends downward to opening 18. The provision of a split at the bottom of cover 10 facilitates the process of placing the cover on the bat. A user, for example, can grab either one or both of the two edges (12*a*, 12*b*) of the split and pull on them to provide assistance in getting the cover on to the bat. Also, a split enables the two edges (12*a*, 12*b*) to overlap each other when pulled tight and fastened, creating a relatively secure attachment of the cover 10 to a bat.

Figure 6:
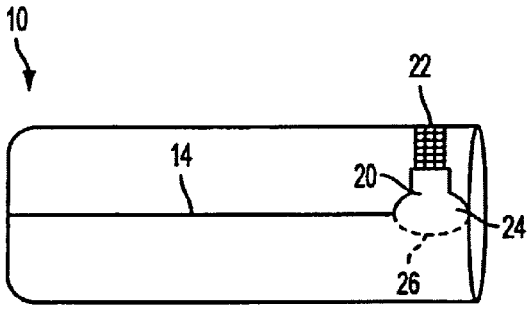
FIG. 6 is a plan view of a protective bat cover, according to an embodiment of the invention.

FIG. 6 illustrates an additional embodiment of the invention wherein the first material piece 12 may be cut into a shape having a first rounded or otherwise shaped tab 24 extending from second edge 12*b*, and a second rounded or otherwise shaped tab 26 (shown in dashed lines in FIG. 6) extending from first edge 12*a*. Similar to the previous embodiment, the first and second edges (12*a*, 12*b*) may be fastened together to form a seam 14 that extends only partially along the length of the cover 10, leaving a split that extends down to opening 18. The VELCRO™ fastening strap 20 is attached to tab 24, allowing the two tabs to overlap one another in a bias position when pulled tight and fastened, creating a more secure attachment of cover 10 to a bat. In an alternative embodiment, either one or both of tabs 24 and 26 may be present.

Figure 7:
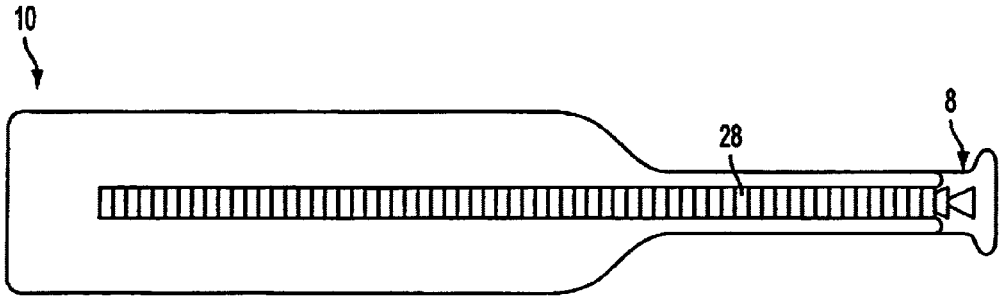
FIG. 7 is a plan view of a protective bat cover encasing a bat, according to yet another embodiment of the invention.

While preferred embodiments of protective cover 10 are illustrated in FIGS. 1–6, various alternatives may exist. In FIG. 7, for example, a protective cover 10 is shown extending along the entire length of a bat 6. Although illustrated with a zipper closure 28, various closure mechanisms including, but not limited to, a series of VELCRO™ straps or button-snaps may be used.

Other embodiments, uses and advantages of the invention will be apparent to those skilled in the art from consideration of the specification and practice of the invention disclosed herein. The specification should be considered exemplary only, and the scope of the invention is accordingly intended to be limited only to the following claims.

I claim:

1. A combination of a bat, and a removable, protective bat barrel cover, the combination comprising:

a bat having a handle portion at a proximal end and a barrel portion at a distal end, wherein the barrel portion is substantially uniform in diameter, and wherein the diameter of the handle portion is less than the diameter of the barrel portion; and a removable, protective bat barrel cover covering the barrel portion of the bat, the protective bat barrel cover comprising:

a first piece of elastic rubber material having a first edge and an opposing second edge fastened together to form a substantially tubular casing having a first open end for receiving the barrel portion of the bat, and a second end closed off by a second piece of elastic rubber material fastened to the first piece of elastic rubber material;

wherein the first edge and opposing second edge of the first piece of elastic rubber material are fastened together only partially along their respective lengths to form a split that begins nearest to and extends into the first open end of the substantially tubular casing;

wherein the substantially tubular casing further defines an interior cavity of substantially uniform diameter and is adapted to cover substantially only the barrel portion of the bat when the bat is inserted into the interior cavity such that an end of the barrel portion abuts the closed second end of the substantially tubular casing; and fastening means mounted on the substantially tubular casing adjacent to the open end for securing the cover to the barrel portion of the bat.

2. A method for protecting a baseball or softball bat when the bat is not in use, the bat having a barrel portion and a handle portion, wherein the barrel portion is substantially uniform in diameter, and wherein the diameter of the handle portion is less than the diameter of the barrel portion, the method comprising the steps of:

(a) providing a protective bat barrel cover comprising a first piece of neoprene material having a first edge and an opposing second edge fastened together to form a substantially tubular casing having a first open end, and a second end closed off by a second piece of neoprene material fastened to the first piece of neoprene material, wherein the first edge and opposing second edge of the first piece of neoprene material are fastened together only partially along their respective lengths to form a split that begins nearest to and extends into the first open end of the substantially tubular casing, and wherein the substantially tubular casing further defines an interior cavity of substantially uniform diameter;

(b) sliding the first open end of the substantially tubular casing over the barrel portion of the bat until the closed second end of the substantially tubular casing abuts the end of the barrel portion of the bat; and (c) fastening the bat barrel cover to the barrel portion of the bat using fastening means mounted on the substantially tubular casing adjacent to the open end.

* * * * *